United States Patent [19]

Newington

[11] 4,238,800

[45] Dec. 9, 1980

[54] WHIP ANTENNA WITH CAPACITIVE LOADING

[75] Inventor: Geoffrey T. Newington, Portsmouth, England

[73] Assignee: The Marconi Company Limited, Chelmsford, England

[21] Appl. No.: 6,294

[22] Filed: Jan. 25, 1979

[30] Foreign Application Priority Data

Feb. 7, 1978 [GB] United Kingdom ..... 4876/78

[51] Int. Cl.[3] ..... H01Q 1/32

[52] U.S. Cl. ..... 343/715; 343/749

[58] Field of Search ..... 343/713, 715, 749, 900

[56] References Cited

U.S. PATENT DOCUMENTS

| | | | |
|---|---|---|---|
| 2,715,184 | 8/1955 | Cork | 343/749 |
| 3,176,298 | 3/1965 | Nettles | 343/749 |
| 3,541,554 | 11/1970 | Shirey | 343/715 |
| 3,945,014 | 3/1976 | Kunert et al. | 343/713 |
| 4,148,030 | 4/1979 | Foldes | 343/895 |
| 4,160,979 | 7/1979 | Drewett | 343/895 |

*Primary Examiner*—Eli Lieberman

*Attorney, Agent, or Firm*—Kirschstein, Kirschstein, Ottinger & Cobrin

[57] ABSTRACT

A whip antenna is constructed in three sections which screw together end-to-end to form the complete antenna. Each section comprises a flexible fibreglass rod which is surrounded by a sleeve of braided copper wire over a major part of its length, this sleeve serving to pass radio frequency current along the section during use of the antenna. One or more of the sections includes a capacitor or series connected capacitors connected in the radio frequency path along the antenna. Utilizing the fibreglass rod as a dielectric the capacitor electrodes are formed either by copper tape or conducting paint lying on the surface of the rod, the electrodes being digitally or helically intermeshed. Alternatively the electrodes may be formed as metallic rings surrounding the fibreglass rod and a conducting rod within the fibreglass rod.

4 Claims, 6 Drawing Figures

WHIP ANTENNA WITH CAPACITIVE LOADING

Figure 1:
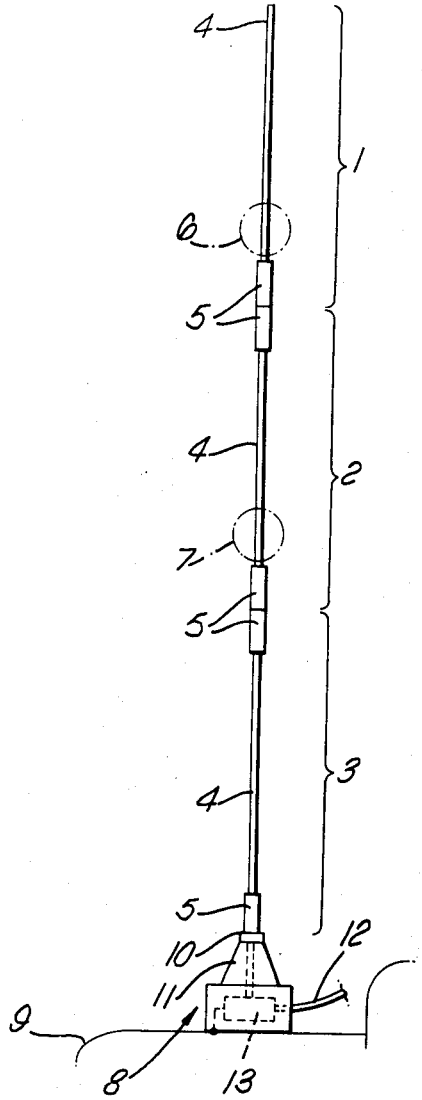

This invention relates to radio antennae and is more particularly concerned with whip antennae.

In the specification of U.S. Pat. No. 4,092,646 there is described a construction of whip antenna having capacitive loading to modify the current distribution along the antenna. The antenna consists of three sections which screw together and, to achieve the desired flexibility, each section has a fiberglass rod which extends over a major part of the length of the section and which is surrounded by a close-fitting sleeve of braided copper wire over most of its length to provide the required radio frequency path. Two of the sections have capacitive loading in like manner and, in each case, this is provided by a capacitor formed by two lengths of copper tape, the two lengths of tape lying generally parallel to the longitudinal axis of the rod and being secured to the surface of the rod so that they lie opposite one another. It has now been realised that capacitive loading may be achieved by other capacitor arrangements without significantly affecting the overall flexibility of the antenna.

Thus, according to one aspect of the present invention, in a whip antenna, or section for such an antenna, having an elongated flexible core of electrically insulating material which extends along a major part of the length of the antenna or section and which carries on its surface electrically conducting material to provide the required radio frequency path along the antenna, a capacitor is connected in said path, said capacitor being formed by a pair of electrodes which are carried by and lie on the surface of said core along part of its length, the pair of electrodes being shaped and disposed so that either portions of the two electrodes intermesh or the two electrodes constitute interlaced helices the turns of which embrace the core.

The electrodes forming the capacitor may intermesh either circumferentially or longitudinally of the core and are preferably formed by copper tape or foil.

According to another aspect of the present invention, in a whip antenna, or section for such an antenna, having an elongated flexible core of electrically insulating material which extends along a major part of the length of the antenna or section and which carries on its surface electrically conducting material to provide the required radio frequency path along the antenna, a capacitor is connected in said path, said capacitor being formed by a pair of electrodes, one of which is embedded in said core and the other is carried by said core and lies on the surface thereof.

According to yet another aspect of the present invention, in a whip antenna, or section for such an antenna, having an elongated flexible core of electrically insulating material which extends along a major part of the length of the antenna or section and which carries on its surface electrically conducting material to provide the required radio frequency path along the antenna, a capacitor arrangement is connected in said path, said capacitor arrangement being formed by a pair of electrodes which are spaced longitudinally along the core and each of which lies on the surface of the core and a further electrode which is embedded in said core and is capacitively coupled to each of said pair of electrodes.

In each case, the flexible core is preferably fibreglass rod.

Figure 2:
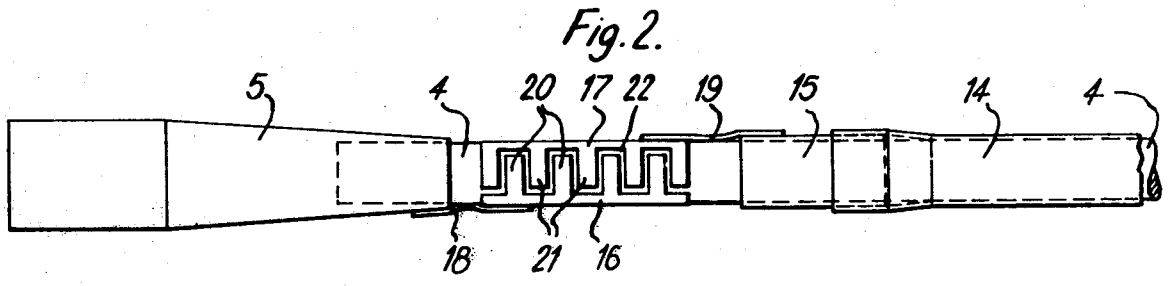
Figure 3:
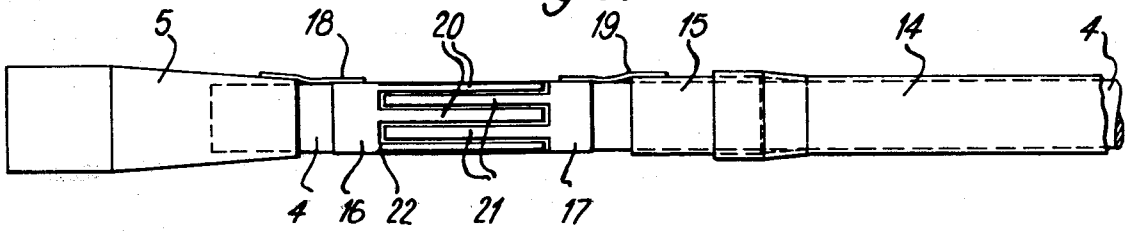
Figure 4:
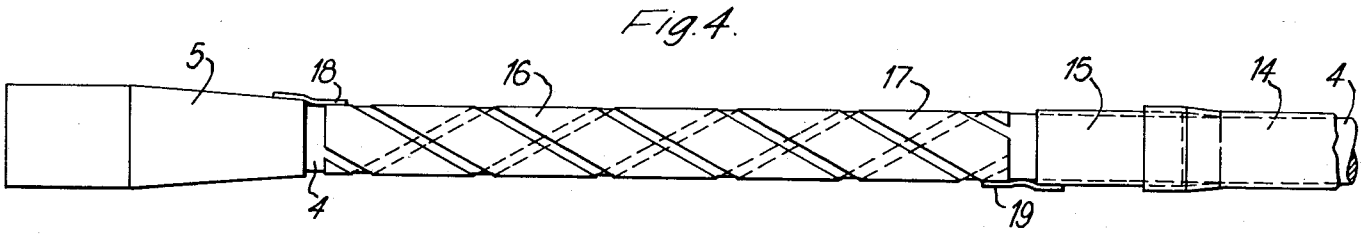
Figure 5:
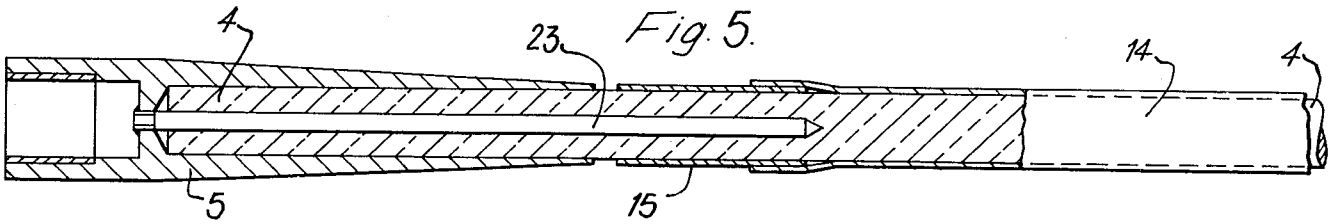
Figure 6:
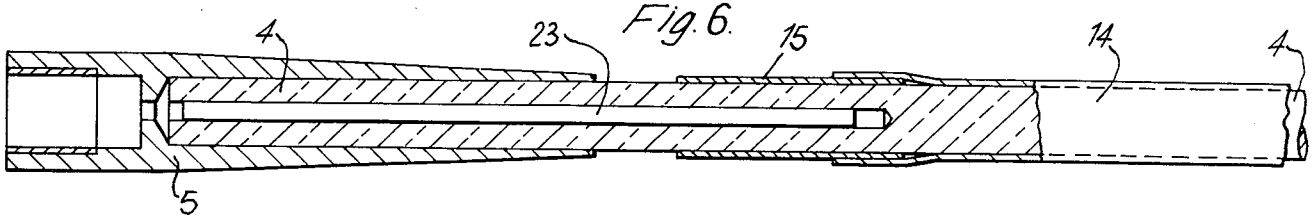

Five alternative forms of sections of whip antenna will now be described with reference to the six figures of the accompanying drawings in which:

FIG. 1 shows in elevation a complete antenna,

FIGS. 2 to 4 respectively show in elevation parts of threee of the sections, and FIGS. 5 and 6 show sectional views respectively of parts of the other two sections.

Referring to FIG. 1 the antenna, for use at frequencies in the region of 30 to 75 megahertz, is in three sections 1, 2 and 3 which screw together to give a total length of approximately three meters. Each of the sections comprises a fibreglass rod 4 having a screw threaded metal ferrule 5 at each end (except at the free end of section 1). The sections 1, 2 and 3 are screwed together by means of the ferrules 5 and can be readily separated and reassembled as required. Apart from the circled portions 6 and 7 each of which constitutes a capacitor (the various embodiments of which are subsequently described) the rod 4 of each of the sections 1, 2 and 3 is surrounded by a close-fitting sleeve of copper braid (not shown on FIG. 1) which is electrically connected either to one electrode of the capacitor 6 or 7 or to the ferrule 5, for example by soldering, to provide the radio frequency path.

In the embodiments under consideration, the complete antenna is mounted on a road vehicle by means of a support 8 secured to the wing 9 of the vehicle. The assembly 8 includes a screw-threaded stud 10 which is carried by an insulator 11 and to which is screwed the ferrule 5 of the section 3 of the antenna. This ferrule 5 is connected in known manner to a coaxial feeder 12 by way of an impedance matching unit 13.

Five separate preferred embodiments of the section 2 of the antenna will now be considered with particular reference to said capacitor provided by the circled portion 7.

Each of the five antenna sections now to be described by way of example with reference to FIGS. 2 to 6 of the accompanying drawings comprises a fibreglass rod 4 secured at one end to a metal ferrule 5, the ferrule 5 being screw-threaded (see FIGS. 5 and 6) to enable it to be secured to a ferrule at the end of the next section of the complete antenna. Over the major part of its length the rod 4 is surrounded by a close-fitting sleeve 14 of braided copper wire to provide the required radio frequency path along the antenna section under consideration. The sleeve 14 is electrically connected to a copper ring 15 through which the fibreglass rod 4 passes and to which it is secured. As so far described, the five antenna sections are essentially the same as each other but, as will subsequently become apparent, different forms of capacitor are connected between the ferrule 5 and the sleeve 14.

In the antenna section of FIG. 2, said capacitor is provided by two electrodes 16 and 17 which are of copper tape or foil and which lie flat on the surface of the fibreglass rod 4 and are secured thereto by suitable adhesive. The ferrule 5 is electrically connected to the electrode 16 by means of a braid pig-tail 18. Similarly the ring 15 is electrically connected to the electrode 17 by a braid pigtail 19. The electrodes 16 and 17 are shaped so as to provide fingers 20 and 21 which intermesh so as to leave a meandering gap 22 between the two electrodes 16 and 17. There is a similar meandering gap 22 between the electrodes 16 and 17 on the side of the rod 4 which is not visible in the drawings.

The capacitor arrangement of FIG. 3 is similar to that of FIG. 2 except that instead of fingers 20 and 21 of the electrodes 16 and 17 intermeshing longitudinally of the rod 4 they intermesh circumferentially of the rod 4. In this case each of the electrodes 16 and 17 completely embraces the rod 4 and the fingers 20 and 21 intermesh right around the circumference of the rod 4.

The capacitor arrangement of FIG. 4 is again similar to that of FIG. 2, but in this case the electrodes 16 and 17 which are again of copper tape or foil are arranged in two interlaced helices, each of these helices having a plurality of turns which embrace the rod 4.

Referring now to FIG. 5 of the accompanying drawings, the next embodiment of an antenna section to be described has a metal rod 23 which is embedded in the fibreglass rod 4 and which is coaxial therewith. At one end the rod 23 is screwed into the ferrule 5 and is thus electrically connected to the ferrule 5. At the other end, the rod 23 lies opposite the copper ring 15, the required capacitor which is effectively connected between the ferrule 5 and the sleeve 14 being mainly provided by the rod 23 and the ring 15.

The antenna section of FIG. 6 is essentially similar to that of FIG. 5 except that instead of the rod 23 being electrically connected to the ferrule 5, it is electrically insulated therefrom. In this case two capacitors are effectively connected in series between the ferrule 5 and the sleeve 14, one of these capacitors being formed by the ferrule 5 and the rod 23 and the other capacitor being formed by the ring 15 and the rod 23.

In the complete antenna of FIG. 1, the capacitor of the circled portion 6 of the section 1 may have essentially the same construction as that of the circled portion 7 of the section 2.

I claim:

1. A whip antenna comprising an elongated flexible solid core which is of electrically insulating material and which extends along a major part of the length of the antenna, a braided copper wire sleeve on the surface of said core and extending along a major part of the length of the core to provide the required radio frequency path along the antenna and a capacitor arrangement which is connected in said radio frequency path and which comprises at least two electrodes, a first one of said electrodes being embedded in said core and at least a second of said electrodes lying on the surface of and being carried by said core along part of its length and being out of electrical contact with said first electrode.

2. A whip antenna according to claim 1 wherein said capacitor arrangement comprises a single capacitor, said first electrode being in direct electrical contact with the required radio frequency path.

3. A whip antenna according to claim 1 wherein said capacitor arrangement comprises two capacitors, said first electrode being common to said two capacitors and being out of electrical contact with the required radio frequency path one of said capacitors being formed by the first electrode and said second electrode and the other capacitor being formed by said first electrode and a further electrode lying on the surface of and being carried by the core, said further electrode being out of electrical contact with both said other electrodes.

4. A whip antenna according to claim 1, wherein said core is formed in at least two sections and there are provided means detachably to secure said sections to one another to form the complete antenna.

* * * * *